US009849675B2

(12) United States Patent
Albertin et al.

(10) Patent No.: US 9,849,675 B2
(45) Date of Patent: Dec. 26, 2017

(54) PROTECTION DEVICE FOR INK-JET PRINTHEAD

(75) Inventors: Alberto Albertin, Arnad (IT); Silvano Tori, Arnad (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 13/516,597

(22) PCT Filed: Dec. 16, 2009

(86) PCT No.: PCT/IB2009/055781
§ 371 (c)(1),
(2), (4) Date: Jun. 15, 2012

(87) PCT Pub. No.: WO2011/073727
PCT Pub. Date: Jun. 23, 2011

(65) Prior Publication Data
US 2012/0249689 A1 Oct. 4, 2012

(51) Int. Cl.
*B41J 2/165* (2006.01)

(52) U.S. Cl.
CPC ..... *B41J 2/16505* (2013.01); *B41J 2/16552* (2013.01)

(58) Field of Classification Search
CPC ..... B41J 2/16505; B41J 2/16552
USPC ..... 347/85
See application file for complete search history.

(56) References Cited

U.S. PATENT DOCUMENTS 6,293,648 B1 * 9/2001 Anderson ..... 347/29
6,820,970 B2 * 11/2004 Long ..... B41J 2/185 347/73
7,614,710 B2 * 11/2009 Haines et al. ..... 347/7
2009/0109257 A1 * 4/2009 Shimazaki ..... 347/31
2010/0171789 A1 * 7/2010 Mun ..... B41J 2/16511 347/31

FOREIGN PATENT DOCUMENTS

JP 2001301186 A * 10/2001
JP 2004 188904 A 7/2004

OTHER PUBLICATIONS

Pullulan-based hydrogel for smooth muscle cell culture.Aude Autissier, Didier Letourneur, Catherine Le Visage. Published online Feb. 12, 2007 in Wiley InterScience (www.interscience.wiley.com). DOI: 10.1002/jbm.a.30998.*
International Search Report and Written Opinion issue in PCT/IP2009/055781 dated Sep. 17, 2010.

* cited by examiner

*Primary Examiner* — Julian Huffman
*Assistant Examiner* — Michael Konczal
(74) *Attorney, Agent, or Firm* — Greenblum & Bernstein, P.L.C.

(57) ABSTRACT

The present invention relates to a protection device for ink-jet printheads, comprising: a tank confining a cavity adapted to contain a humidifying liquid and having a mouth designed to be associated with at least one nozzle of an ink-jet printhead; a seal disposed around the mouth and suitable to be put sealingly in engagement against the printhead and around the nozzle; a mechanism integrated into the tank, for opening or closing the mouth for selectively bringing the mouth into fluid communication with the cavity.

18 Claims, 6 Drawing Sheets

PROTECTION DEVICE FOR INK-JET PRINTHEAD

The present invention relates to a protection device for ink-jet printheads.

It is known that an ink-jet printer comprises at least one printhead from which ink droplets are emitted through nozzles and directed onto a medium to be printed. The printhead is movable relative to the medium through suitable actuating mechanisms and when it is not used is positioned in a service area installed on board the printer and therein carried by the actuating mechanisms themselves or, for longer periods of halt, it is dismantled and stowed in a storage container separated from the printer. The nozzles of the ink-jet printhead, when the printhead is in the service area of the printer or in the storage container, are kept in a bounded environment by means of a protection device comprising a rubber element referred to as "capping". In the capping greater humidity than in the environment is generated, due to vaporisation of the water contained in the ink, and this prevents the printhead ink in the region close to the nozzles from drying.

For instance, document U.S. Pat. No. 6,293,648 discloses a protection device to be positioned under the printhead for sealingly closing and humidifying the printhead nozzles. The device comprises a housing body containing a liquid and having a plurality of apertures defined through an upper wall. Each aperture is provided with a seal for engagement against the printhead at a region surrounding one or more nozzles. A wick is inserted in each aperture and is partly dipped in the liquid. The liquid is transferred by capillarity from the wick to the apertures in such a manner that the space confined between the seals and the container is humidified. The device described in document U.S. Pat. No. 6,293,648 is further provided with a sealing film covering the apertures till the first use, when the film is to be removed and disposed of.

The Applicant has noticed that, when the devices of the known art as the one disclosed in document U.S. Pat. No. 6,293,648 are not associated with the printhead, i.e. when the printhead is printing, the liquid contained in the housing body is directly in communication with the external environment through said apertures and inevitably evaporates and is dispersed in the air.

The Applicant has further noticed that if the device is pulled out of the printer or of the storage container before the liquid inside it is used up, handling of it may give rise to unintentional leakage of the liquid.

The Applicant has found that the above mentioned drawbacks of the known art can be solved if protection device for ink-jet printheads is made, which protection device is provided with a tank for a humidifying liquid in which the opening designed to be associated with the printhead can be selectively and automatically closed or opened, in the absence or in the presence of the printhead respectively.

More specifically, according to a first aspect, the present invention relates to a protection device for ink-jet printheads comprising: a tank confining a cavity adapted to contain a humidifying liquid and having a mouth designed to be associated with at least one nozzle of an ink-jet printhead; a seal disposed around the mouth and able to be put sealingly in engagement against the printhead and around said at least one nozzle; characterised in that it comprises a mechanism integrated into the tank, for opening and closing said mouth for selectively bringing said mouth into fluid communication with the cavity.

The present invention, in at least one of the aforesaid aspects, can have one or more of the preferred features hereinafter described.

Preferably, the mechanism comprises a movable element installed on the tank and movable between a closing position of the mouth and an opening position of the mouth.

Preferably, said movable element is actuated from the closing to the opening positions by a pressure exerted against said movable element.

The mechanism is relatively simple, since the opening is controlled by the relative movement of the printhead pressing against the device.

Preferably, said movable element carries the seal.

It is the seal itself that, by exerting pressure against the printhead, determines displacement of the movable element.

Preferably, the mechanism comprises at least one spring interposed between said movable element and the tank and adapted to push said movable element to the closing position.

The automatic closure is obtained in a simple and efficient manner through use of the spring.

Preferably, the mechanism comprises a closure member fitted in the mouth; wherein in the open position said closure member together with the movable element confines a peripheral opening communicating with the cavity; wherein in the closing position said closure member has a first abutment surface in contact with a second abutment surface of the movable element.

The opening extends all around the nozzle or nozzles of the printhead and this geometric extension promotes a homogeneous humidification of the environment enclosed between said printhead and the protection device.

Preferably, the closure member is fastened onto the tank.

Preferably, the tank comprises a support extending in the cavity from a bottom wall of said tank to the mouth, and the closure member is fitted on one end of said support.

Preferably, the spring is a helical spring and is disposed around the support.

Due to the above features, the device is of simple construction.

Preferably, the device comprises a flexible wall, preferably made of rubber, connecting the movable element to peripheral edges of the tank.

Bending of the wall follows the movement of the movable element and at the same time ensures the hermetic tightness of the tank, preventing the liquid therein contained from evaporating. Preferably, the rubber wall is co-moulded with the seal and the movable plastic element, so as to create a hermetic seal and prevent vapour escape by leakage. In addition, preferably, the rubber wall is fastened to the peripheral edges of the container by a plastic frame co-moulded with the rubber wall and welded by ultrasonic waves to the container.

The rubber used for said wall must have a weak vapour-transmission coefficient to avoid water leakage therethrough.

Preferably, the overall evaporation rate of the protection device in the closed position is lower than 2 mg/day, preferably lower than 1.7 mg/day (measured with an ambient temperature of 22-25° C. and a relative humidity of 45-55%).

Preferably, the tank is made of Noryl™ SE1 GFN2 by SABIC. Preferably, the closure member is made of Novodur P2 H/AT 010555 by Ineos and, preferably, the rubber of the flexible wall is Santoprene™ 8191-55B100 by Exxon Mobil.

Preferably, according to an embodiment, the tank is filled with an hydrophilic composition (i.e. hydrophilic polymer) which, together with the humidifying liquid (i.e. water), forms an hydrogel composition provided with the same evaporation ratio of the liquid itself. The humidifying liquid is retained in the gel and also if the mouth of the device is open and the device overturned, no leakage of the liquid is permitted.

In a second aspect, the present invention relates to an ink-jet printer comprising at least one ink-jet printhead having at least one nozzle and at least one protection device in accordance with the above description.

Preferably, the protection device is movable between a first position, at which the mouth is spaced apart from the printhead nozzle, and a second position at which the mouth is associated with said nozzle; wherein in the first position the movable element is in the closing position of the mouth and in the second position the movable element is in the opening position of said mouth.

Preferably, the protection device comprises a projecting element, and wherein the printhead acts against said projecting element to take it from the first to the second positions.

The opening and closing movements of the protection device are controlled by the movement of the printhead. The device and printer therefore do not comprise motors specifically dedicated to opening or closing of the mouth of the protection device. The printer structure keeps unchanged as compared with the printers provided with protection devices of known type. The device according to the invention can apply to printers already on the market without any modification of same being required.

In a third aspect, the present invention relates to a servicing device for ink-jet printheads, comprising a supporting frame to be installed in an ink-jet printer and a protection device as above described.

Preferably, the protection device is movable on guides of the supporting frame between a first position, at which the mouth of the protection device is spaced apart from the printhead nozzle, and a second position at which the mouth is associated with said nozzle; wherein in the first position the movable element is in the closing position of the mouth and in the second position the movable element is in the opening position of said mouth.

The servicing device preferably also comprises a portion of absorbent material and a scraper element. The printhead, brought close to the servicing device, first passes on the portion of absorbent material, where ejection towards the absorbent material itself of the ink drops remained in the nozzles is operated, and subsequently on the scraper where the ink residues present on the nozzles are removed.

Preferably, the protection device is removably engaged on the frame of the servicing device.

In accordance with a fourth aspect, the present invention relates to an ink-jet printer comprising a servicing device as above described.

Preferably, the servicing device is installed on the printer in a removable manner.

The protection device or only the frame of the servicing device or the whole servicing device (comprising the protection device) can be easily extracted from the printer and replaced, usually together with the printhead.

Alternatively, the tank of the protection device can be refilled with the humidifying liquid and therefore its working lifetime is longer than that of the printhead and of the frame of the servicing device. The protection device will be extracted from the frame and housed in a new frame before being re-inserted in the printer with a new printhead.

In accordance with a fifth aspect, the present invention relates to a storage container for ink-jet printheads comprising at least one protection device as described above.

The storage container, known as "garage", is a box separated from or integrated into the printer and capable of receiving one or more printheads for long periods of non-use of the latter.

In this case, the working lifetime of the protection device must substantially correspond to the working lifetime of the printer (several years). It is therefore preferable for the tank to be refilled a plurality of times.

Further features and advantages will become more apparent from the detailed description of a preferred but not exclusive embodiment of a servicing device for ink-jet printheads comprising a protection device in accordance with the present invention.

This description will be set out hereinafter with reference to the accompanying drawings, given by way of non-limiting example, in which.

Figure 1:
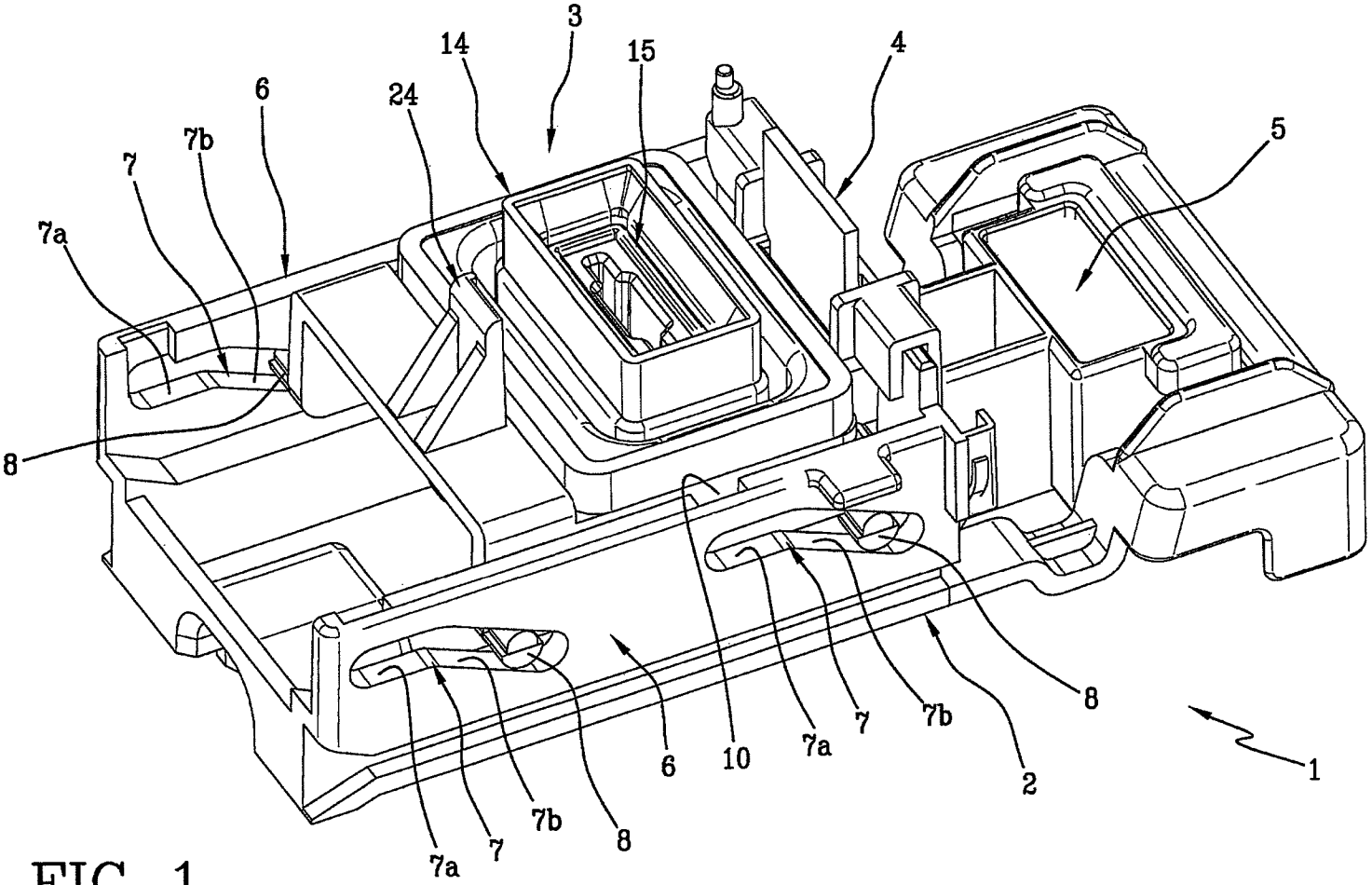
FIG. 1 is a perspective view of a servicing device for ink-jet printheads comprising a protection device according to the present invention in a first position.

With reference to the drawings, a servicing device for ink-jet printheads has been generally denoted at 1. The servicing device 1 can be installed in a service area of an ink-jet printer (not shown) to which the printhead or printheads "H" are brought at the end of a printing cycle, preferably by the same mechanisms actuating them during printing, for carrying out cleaning operations and keep the nozzles "N" in an efficient condition.

The servicing device 1 comprises a supporting frame 2 that can be installed in a removable manner in the service area of the printer. Frame 2 has a housing for a protection device 3 for ink-jet printheads and further comprises a scraper element 4 and a portion of absorbent material 5. In the embodiment shown, the scraper element 4 is interposed between the protection device 3 and the portion of absorbent material 5 and, when device 1 is fitted in the printer, the mentioned three components 3, 4 and 5 are aligned along a movement direction of the printhead "H".

The housing is confined by two side walls 6 belonging to the frame 2 and each having a pair of guides 7 defined by grooves formed in said walls 6. In greater detail, each groove 7 has a horizontal length 7*a* parallel to a reference plane, not shown, in which the surface of printhead "H" in which the printing nozzles are formed lies, and an oblique length 7*b* extending without a break from the horizontal length 7*a* to a base portion of frame 2. The protection device 3, described in detail in the following, has pins 8 each of which is fitted in a respective guide 7 in such a manner that they can slide therein. By its sliding in guides 7, the protection device 3 is movable between a first lowered position and a second raised position. In the first lowered position (FIG. 1), pins 8 lie at the ends of the oblique lengths 7*b* and device 3 is positioned at the base portion of frame 2. In the second raised position (FIG. 2), pins 8 lie at the ends of the horizontal lengths 7*a* and device 3 is spaced apart from the base portion of frame 2. A return spring, not shown, retains the protection device 3 in the first lowered position, in the absence of external stresses.

The scraper element 4 is a flexible plate made of plastic or rubber for example, having one end mounted on frame 2 and the opposite end free.

The portion of absorbent material 5 consists of a porous material adapted to absorb the liquids and is housed in a suitable seat formed in frame 2. When device 1 is mounted in the printer and the printhead "H" is in the service area, the free end of the scraper element 4 and the free surface of the absorbent material 5 are turned towards the nozzles "N" of said printhead "H".

The protection device 3 comprises (FIGS. 3 and 4) tank 9 of a cup-shaped structure preferably having a rectangular base and preferably made of plastic material. The tank internally delimits a cavity 9*a* adapted to contain a humidifying liquid "L" (water for example, possibly added with chemical bactericidal, fungicidal and the like agents). Two of the aforesaid pins 8 are positioned on each of two opposite side walls 10 of tank 9.

Preferably, according to an embodiment, the cavity 9*a* is filled with an hydrophilic composition (i.e. hydrophilic polymer) which, together with the humidifying liquid "L", forms an hydrogel composition provided with the same evaporation ratio of the liquid itself.

A support 12 of a cylindrical shape extends from a bottom wall 11 of tank 9; it is perpendicular to said bottom wall 11.

The upper edges of tank 9 are connected to a flexible wall 13 made of rubber which partly closes the opening of tank 9 surrounded by said edges.

The flexible wall 13 at a central region thereof carries a movable element 14. The movable element 14 comprises four side walls 14*a* delimiting a mouth 15 that can be selectively brought into fluid communication with cavity 9*a*.

A seal 16 is disposed on the upper edges of the side walls 14*a* and it fully covers said side walls 14*a*. An inner surface 16*a* of the seal 16 delimiting mouth 15 has an outwardly diverging portion, i.e. towards the printhead "H" when the latter is associated with the protection device 3. Seal 16 forms a unitary piece with the flexible wall 13 and is preferably co-moulded with (or over-moulded to) the movable element 14. The flexible wall 13 is further preferably co-moulded with (or over-moulded to) a frame 17 made of plastic material and in turn joined, preferably by ultrasonic wave welding, to the upper edges of tank 9. The rubber material forming the flexible wall 13 and the seal 16 is suitable for co-moulding or over-moulding on the plastic material and has a weak vapour transmission coefficient. This rubber material is preferably Santoprene™ 8191-55B100 by Exxon Mobil.

Preferably, the tank 9 is made of Noryl™ SE1 GFN2 by SABIC.

Preferably, the overall evaporation rate of the protection device in the closed position is lower than 2 mg/day, preferably lower than 1.7 mg/day (measured with an ambient temperature of 22-25° C. and a relative humidity of 45-55%).

A helical spring 18 is disposed around the support 12 and has a first end in abutment against the bottom wall 11 of tank 9 and a second end, opposite to the first one, in abutment against a lower portion of the movable element 14.

An upper end of the support 12 carries a closure member 19 shaped like a mushroom. The closure member 19 is secured to support 12 by means of a screw 20. Preferably, the closure member 19 is made of Novodur P2 H/AT 010555 by Ineos.

The closure member 19 is placed in mouth 15 and is surrounded by the inner surface 16*a* of seal 16.

The head of the closure member 19 has a first abutment surface 21 turned towards the bottom wall 11 and facing a second abutment surface 22 belonging to the inner surface 16*a* of seal 16.

The movable element 14, spring 18 and closure member 19 are part of an opening and closing mechanism of said mouth 15 integrated into tank 9.

Figure 3:
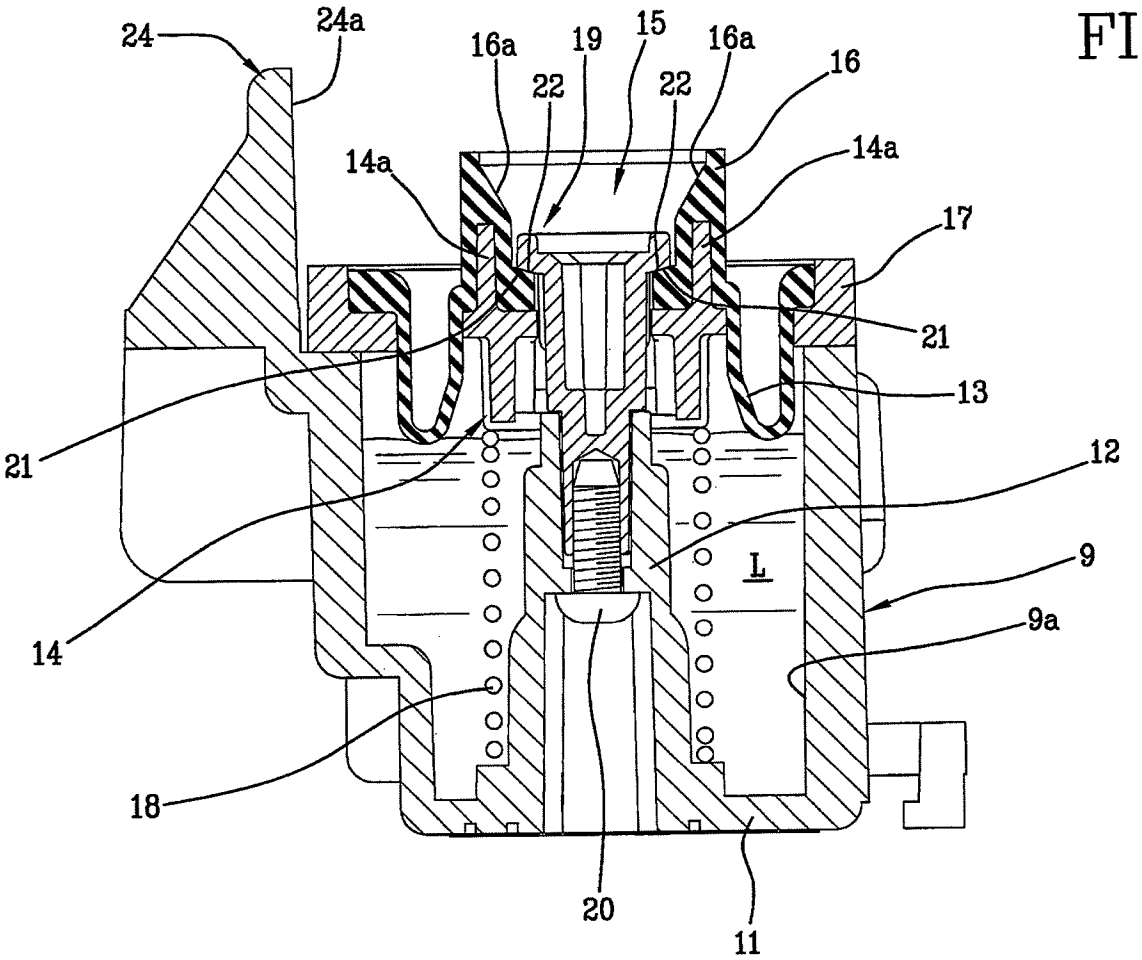
FIG. 3 is a cross-sectional view of the protection device in FIG. 1 in a first operating configuration.

In the absence of external forces acting on the movable element 14, spring 18 pushes and keeps the second abutment surface 22 belonging to seal 16, against the first abutment surface 21 of the closure member 19 (FIG. 3). The seal 16 is tightly fitted against the closure member 19 and the mouth 15 is closed, i.e. is not in fluid communication with the cavity 9*a* of tank 9.

Figure 4:
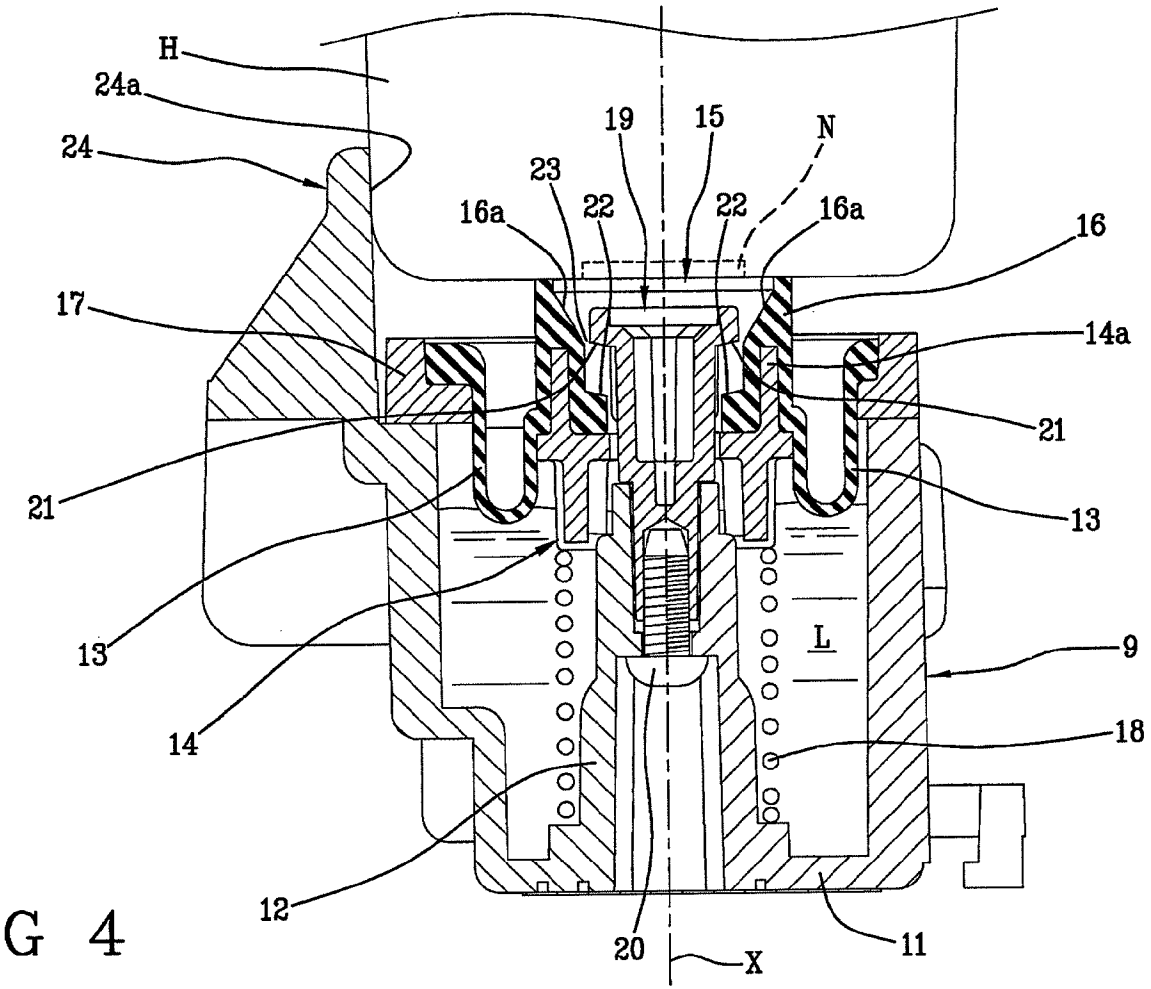
FIG. 4 is a cross-sectional view of the protection device in FIG. 1 in a second operating configuration and associated with a printhead shown diagrammatically.

By a pressure exerted on an upper edge of seal 16, the movable element 14 is pushed, against the action of spring 18, in a movement direction along an X axis, towards the bottom wall 11 of tank 9. The second abutment surface 22 is separated from the first abutment surface 21 and a passage is opened that brings mouth 15 into communication with the cavity 9*a* of tank 9 (FIG. 4). This passage is defined by a peripheral opening 23 surrounding the head of the closure member 19. If the force exerted on the upper edge of seal 16 stops, spring 18 recloses mouth 15 (FIG. 3).

The yielding quality of the flexible wall 13 therefore must be capable of enabling lowering of the movable element 14 under the thrust action exerted by the printhead "H" and return to the closed position, due to the thrust of spring 18.

The protection device 3 further comprises a projecting element 24 extending from tank 9 to the printhead "H" and has a surface 24*a* parallel to the movement direction axis X of the movable element 14. This surface 24*a*, when the protection device 3 is mounted on frame 2, is turned towards the scraper element 4.

In use, at the end of a printing cycle, the printhead "H" is brought to the service area wherein it is first stopped over the portion of absorbent material 5 and then operated for ejection of the ink drops entrapped in nozzles "N". The protection device 3 is in the lowered position shown in FIG. 1 and closed.

Subsequently, the printhead "H" is shifted towards the protection device 3 and passes on the scraper element 4 removing the ink residues present on nozzles "N".

Figure 2:
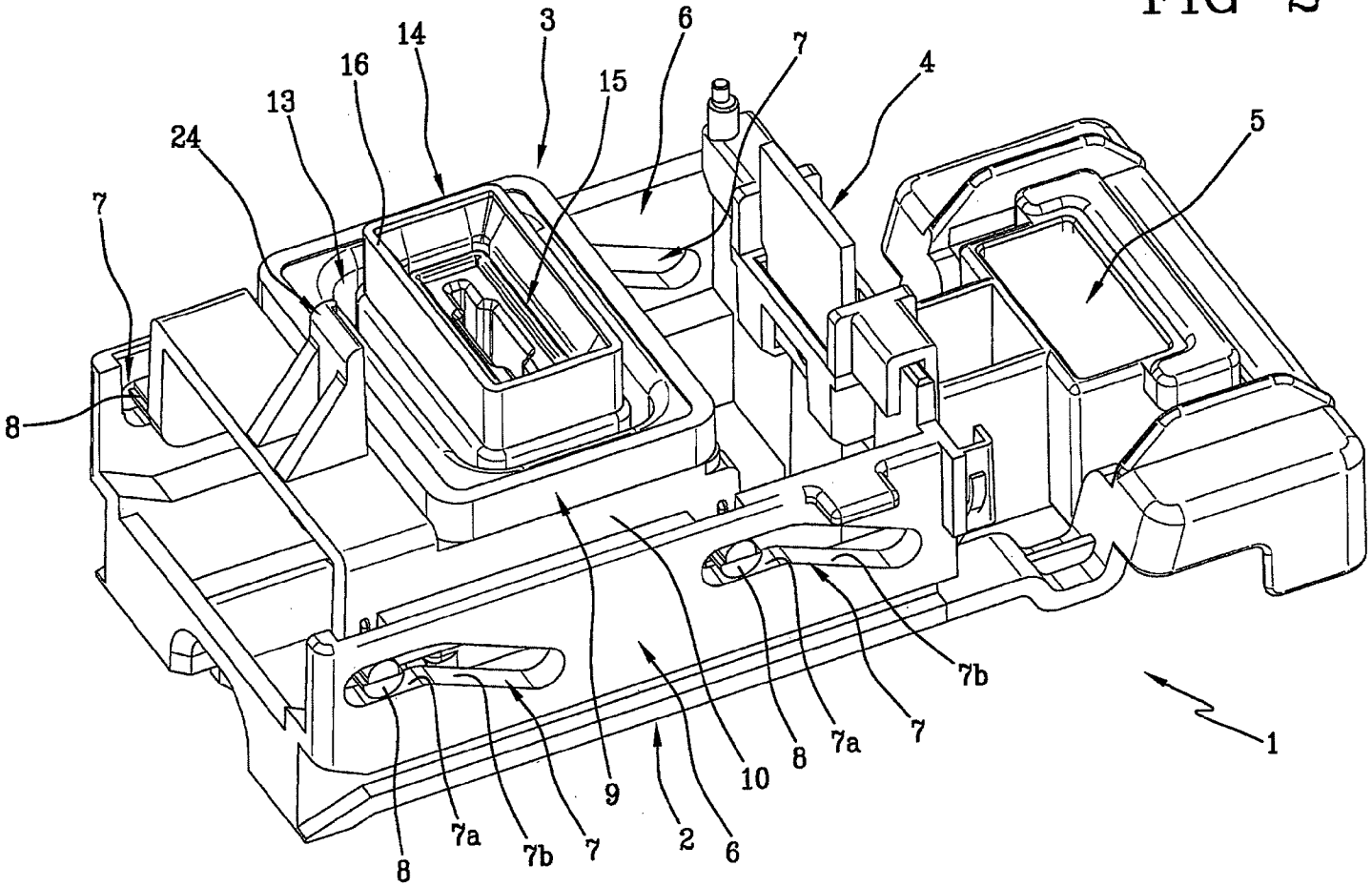
FIG. 2 shows the servicing device in FIG. 1 with the protection device in a second position.

Going on moving, the printhead "H" or an element integral therewith impacts against the surface 24*a* and drags along the protection device 3 towards the second raised position shown in FIG. 2 (in which figure, the printhead "H" being absent, the mouth 15 is represented in a closed position), against the action of the return spring. During this movement, seal 16 comes into contact with the printhead "H" and raising of the movable element 14 is stopped while the rest of the protection device 3 goes on raising, causing the relative movement between the movable element 14 and the closure member 19 and opening of mouth 15.

The vapour inside tank 9 flows through the peripheral opening 23 filling the volume delimited by seal 16 and the printhead "H" (FIG. 4), preventing the ink still present in nozzles "N" from drying.

When the printhead "H" has to print again, it is moved away from the service area, the return spring brings the protection device 3 back to the first position lowered on frame 2 and the movable element 14 pushed by spring 18 closes tank 9.

The protection device 3 according to the invention is also applicable in a storage container 25 inside which the printheads "H" are positioned, after dismantling from the carriage moving them during printing, if they are not to be used for a long period of time. The storage container 25 is a box in which a housing 26 is formed for one or more printheads. In accordance with the present invention, the storage container 25 comprises one or more protection devices 3 located in suitable seats. When a printhead "H" is housed in the container 25, it exerts a thrust action against the movable element 14 and opens mouth 15, in the same manner as shown in FIG. 4.

Figure 5:
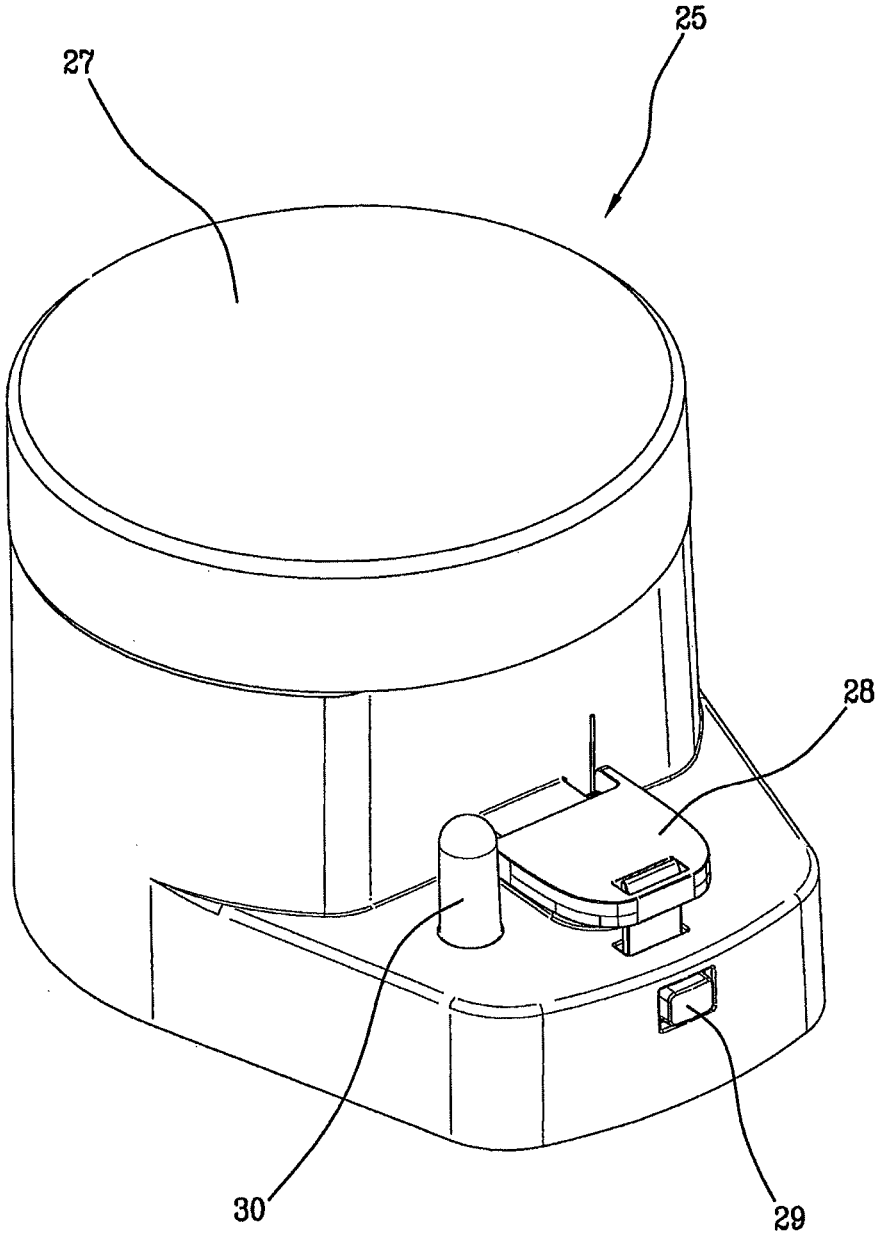
FIG. 5 is a first perspective view of a storage container or garage for ink-jet printheads.
Figure 6:
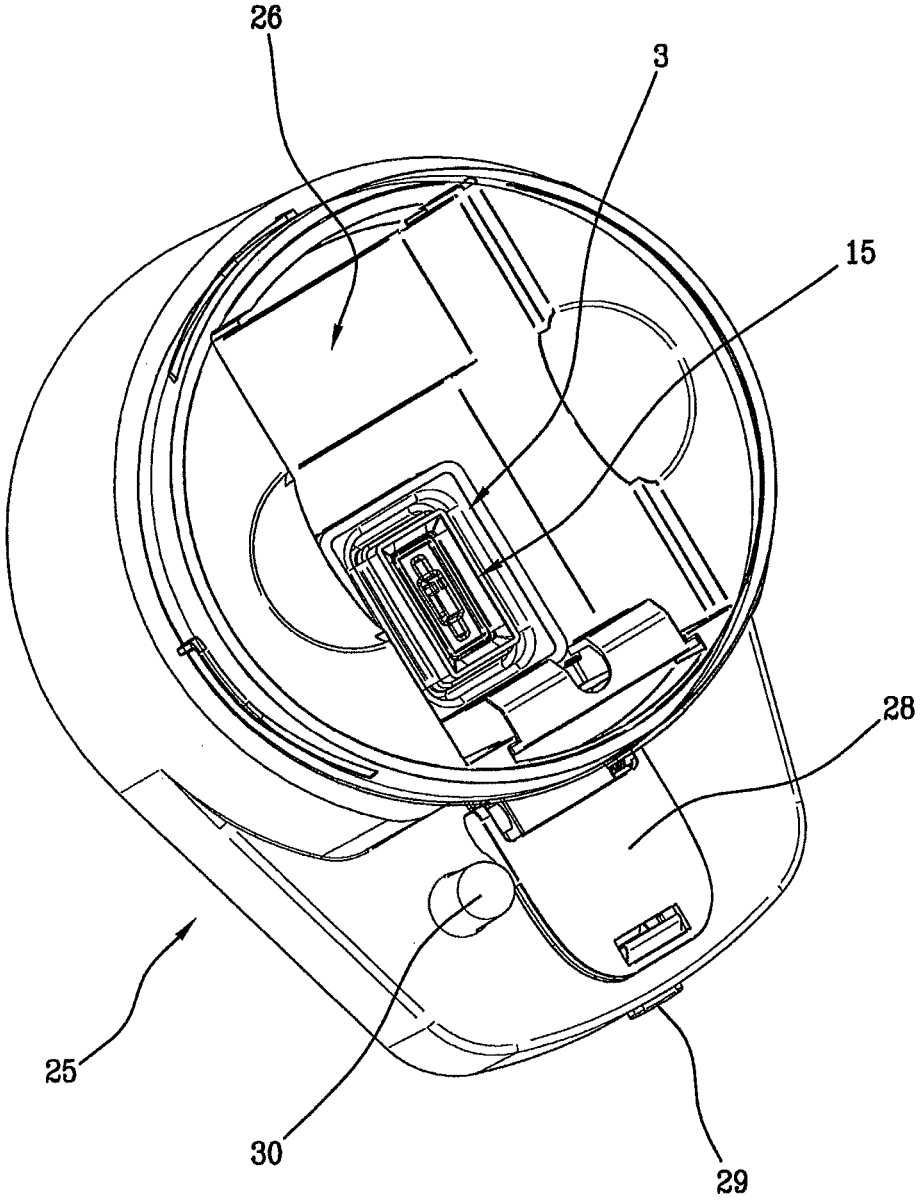
FIG. 6 is a second perspective view of the storage container of FIG. 5.

The embodiment of the storage container 25 shown in FIGS. 5 and 6 presents a cylindrical shape and is provided with a cover 27 covering one single housing 26 for a single printhead "H". The storage container 25 comprises one single protection devices 3. The mouth 15 of such a device 3 is visible, in FIG. 6, on the bottom wall of the housing 26.

The storage container 25 further presents an access opening, not visible, covered by a movable lid 28 for refilling the tank of the device 3 which is part of the storage container 25. The lid 28 can be opened by means of a push button 29. The storage container 25 is also provided with an indicator 30 of the level of water contained inside the tank.

The invention claimed is:

1. A protection device for ink-jet printheads comprising:
a tank confining a cavity having an open end;
a hydrogel composition confined in said cavity and comprising a hydrophilic composition and a humidifying liquid;
a seal arranged at the open end of the cavity for movement relative to the cavity, the seal having a sealing surface to surround at least one nozzle of an ink-jet printhead and sealingly engage the printhead and having an interior surface defining a mouth;
a mechanism integrated within the tank to selectively bring said mouth into fluid communication with the cavity; and
a closure member coupled to the tank,
wherein the mechanism is movable so that, before the seal sealingly engages the printhead, the closure member is in a sealing position against the seal, and, after the seal sealingly engages the printhead, the seal is movable out of the sealing position with the closure member, which brings the mouth into fluid communication with the cavity.

2. A device as claimed in claim 1, wherein the mechanism comprises a movable element installed on the tank and movable between a closing position of the mouth and an opening position of said mouth.

3. A device as claimed in claim 2, wherein said movable element is actuated from the closing to the opening positions by a pressure exerted against said movable element.

4. A device as claimed in claim 2, wherein said movable element carries the seal.

5. A device as claimed in claim 2, wherein the mechanism comprises at least one spring interposed between said movable element and the tank and adapted to push said movable element to the closing position.

6. A device as claimed in claim 2, wherein in the opening position said closure member together with the movable element confines a peripheral opening communicating with the cavity, and wherein in the closing position said closure member has a first abutment surface in contact with a second abutment surface of the movable element.

7. A device as claimed in claim 6, wherein the closure member is fastened onto the tank.

8. A device as claimed in claim 6, wherein the tank comprises a support extending in the cavity from a bottom wall of said tank to the mouth, and the closure member is fitted on one end of said support.

9. A device as claimed in claim 8, wherein the mechanism comprises at least one spring interposed between said movable element and the tank and adapted to push said movable element to the closing position, and wherein the spring is a helical spring and is disposed around the support.

10. An ink-jet printer comprising at least one ink-jet printhead having at least one nozzle and at least one protection device as claimed in claim 1.

11. A printer as claimed in claim 10, wherein the mechanism comprises a movable element installed on the tank and movable between a closing position of the mouth and an opening position of said mouth, wherein the protection device is movable between a first position, at which the mouth is spaced apart from the nozzle of the printhead, and a second position at which the mouth is associated with said nozzle, and wherein in the first position the movable element is in the closing position of the mouth and in the second position the movable element is in the opening position of said mouth.

12. A servicing device for ink-jet printheads, comprising a supporting frame to be installed in an ink jet printer and a protection device as claimed in claim 1, mounted on the supporting frame.

13. A device as claimed in claim 12, wherein the mechanism comprises a movable element installed on the tank and movable between a closing position of the mouth and an opening position of said mouth, wherein the protection device is movable on guides of the supporting frame between a first position, at which the mouth of the protection device is spaced apart from the nozzle of the printhead, and a second position at which the mouth is associated with said nozzle, and wherein in the first position the movable element is in the closing position of the mouth and in the second position the movable element is in the opening position of said mouth.

14. An ink jet printer comprising a servicing device as claimed in claim 12.

15. A printer as claimed in claim 14, wherein the servicing device is removably installed on the printer.

16. A storage container for ink-jet printheads comprising at least one protection device as claimed in claim 1.

17. A protection device for ink-jet printheads comprising:
a tank confining a cavity having an open end;
a hydrogel composition confined in said cavity and comprising a hydrophilic composition and a humidifying liquid;
a seal arranged at the open end of the cavity for movement relative to the cavity, the seal having a sealing surface to surround at least one nozzle of an ink-jet printhead and sealingly engage the printhead and having an interior surface defining a mouth; and
a mechanism integrated within the tank to selectively bring said mouth into fluid communication with the cavity, wherein the mechanism comprises a movable element installed on the tank and movable between a closing position of the mouth and an opening position of said mouth; and
a flexible wall connecting the movable element to peripheral edges of the tank.

18. An ink-jet printer comprising:

at least one ink-jet printhead having at least one nozzle and at least one protection device that includes a tank confining a cavity having an open end; a hydrogel composition confined in said cavity and comprising a hydrophilic composition and a humidifying liquid; a seal arranged at the open end of the cavity for movement relative to the cavity, the seal having a sealing surface to surround at least one nozzle of an ink-jet printhead and sealingly engage the printhead and having an interior surface defining a mouth; and a mechanism integrated within the tank to selectively bring said mouth into fluid communication with the cavity, wherein the mechanism comprises a movable element installed on the tank and movable between a closing position of the mouth and an opening position of said mouth, wherein the protection device is movable between a first position, at which the mouth is spaced apart from the nozzle of the printhead, and a second position at which the mouth is associated with said nozzle, and wherein in the first position the movable element is in the closing position of the mouth and in the second position the movable element is in the opening position of said mouth, and wherein the protection device comprises a projecting element and wherein the printhead acts against said projecting element to take it from the first to the second positions.

* * * * *